US006672515B2

(12) United States Patent
Rajaram

(10) Patent No.: US 6,672,515 B2
(45) Date of Patent: Jan. 6, 2004

(54) SELF STABILIZING TRACK SYSTEM

(75) Inventor: Bojji Rajaram, Navi Mumbai (IN)

(73) Assignee: Konkan Railwary Corporation Ltd. (IN)

( * ) Notice: Subject to any disclaimer, the term of this patent is extended or adjusted under 35 U.S.C. 154(b) by 0 days.

(21) Appl. No.: 10/206,024

(22) Filed: Jul. 26, 2002

(65) Prior Publication Data

US 2003/0052182 A1 Mar. 20, 2003

(30) Foreign Application Priority Data

Sep. 18, 2001 (IN) ..... 900/MUM/2001

(51) Int. Cl.[7] ..... E01B 1/00
(52) U.S. Cl. ..... 238/2
(58) Field of Search ..... 238/2, 1, 6, 7, 238/10 R, 11, 29, 30; 104/2

(56) References Cited

U.S. PATENT DOCUMENTS 3,756,507 A * 9/1973 Hanig et al. ..... 238/2
3,841,554 A * 10/1974 Bennett ..... 238/2
4,679,731 A * 7/1987 Klugar et al. ..... 238/2

* cited by examiner

*Primary Examiner*—S. Joseph Morano
*Assistant Examiner*—Robert J. McCarry, Jr.
(74) *Attorney, Agent, or Firm*—Muserlian, Lucas and Mercanti

(57) ABSTRACT

A rail track structure for securing railway rails on a ballast track or a solid track includes a standard sleeper used on the ballast track; consisting of a plurality of gabions holding ballast and a resiliently compressible pad placed below the sleeper typically below the rail seat between the sleeper and the gabions.

18 Claims, 5 Drawing Sheets

SELF STABILIZING TRACK SYSTEM

FIELD OF THE INVENTION

The invention relates to a railway track structure formed of at least a pair of rails, which are fastened to sleepers via which they are supported on a bed of ballast material.

This invention also relates to a method of making track structures and a new ballast bed for such track structures.

PRIOR ART

Railway track structures of the type indicated above are generally known. Although these known railway track structures are found to be quite satisfactory, their proper functioning is not quite so easy to keep up.

Continuous movement of traffic causes both disturbances to the packing of the ballast underneath the sleepers and pulverization of the ballast. Particularly a conventional railway track with a ballast bed entirely formed of broken stone or pebbles requires a great deal of maintenance. Especially the practically cohesionless supporting layer rapidly pulverizes to a greater or lesser extent under the influence of the dynamic load of the traffic plying thereon.

Further, the transport capacity of existing or newly laid railway tracks is often required to be increased, which can be realized with heavier and more frequent trains per day that generally attain higher speeds. This increase in transport capacity leads to higher and heavier loads being applied to the railway track in its entirety and to its individual components, an important role being played by the dynamic load of the trains that ply on the rails.

In the case of heavy traffic schedules conventional track maintenance is no longer possible during the day, so that the work must be done at night. The maintenance work is done manually or with the help of machines. Operation of the heavy duty ballast tampers and ballast consolidating machines is very slow and is attended with a high noise level.

Moreover, on railway track sections, which frequently carry bulk material, or in deserts and other loose soil dry areas the ballast bed material, becomes fouled up with this bulk material or sand, which also detracts from the proper functioning of the ballast bed.

As far as the maintenance of these conventionally built railway track structures is concerned, the high demands made on it these days can be met only with great difficulty and generally at prohibitively high cost.

Two separate systems exist as devices for securing railroad rails. On the one hand, the attachments for sleepers or supports on a ballast foundation, and on the other hand the superstructure for a solid track, i.e. securing rails for a superstructure without ballast.

The invention has for its object to provide an improved railway track, which does not have the limitations of the prior art railway tracks and no longer has the aforementioned disadvantages.

SUMMARY OF THE INVENTION

According to this invention there is provided track structure for fastening rails comprising

[i] a ballast bed consisting of a plurality of discrete gabion type inter fitting elements;

[ii] sleepers for fixing rails thereto adapted to be laid and fitted on the said ballast bed;

[iii] resiliently compressible pads adapted to be provided between the said sleepers and the ballast bed.

Typically, the elements of the ballast bed are defined by support box type elements in which ballast material such as pebbles and broken stones is filled.

Typically, the support elements are in the form of wire boxes or in the form of a box having perforated walls.

In accordance with a preferred embodiment of the invention the walls of the support element are tensioned and the ballast material filled in the support elements include resiliently compressible elements such as rubber tyre crumbs.

Typically, the resilient pad is provided between the sleeper and the ballast bed is an elastomeric sheet element reinforced on the inside or the outside, preferably provided on the surface of the gabions forming the ballast bed or within the gabions forming the ballast bed.

In accordance with one embodiment of the invention the support element for the gabions forming the ballast bed has a wall which constitutes the resilient element.

The invention also discloses a method of making a track structure consisting the steps of preparing a sub soil bed for forming the track structure thereon;

filling ballast material in support elements to form ballast gabions;

interfitting the ballast gabions to form a ballast bed over the subsoil bed;

providing resilient elements over distinct sleeper mounting locations on the formed ballast bed; and fitting sleepers over the resilient elements.

According to another aspect of this invention there is provided a ballast bed for the track structure consisting of inter fitting gabions formed by filling support elements with ballast material at least some of the gabions provided with resilient elements for mounting sleepers thereon.

Typically the ballast bed has ballast material, which includes crumbs of resilient material, and the support elements are in the nature of a wire box and the resilient element is a wall of the support element.

In accordance with another embodiment the resilient element is provided either outside or inside the gabion.

According to the invention therefore the railway track structure is characterized in that beneath the sleepers the ballast is confined in wire boxes known as gabions.

In accordance with a preferred embodiment of the invention, the ballast is provided in one or more supporting elements in which the ballast material is filled.

In accordance with another aspect of the invention, it relates to a device for securing railway rails on a ballast track or a solid track in a highly resilient manner.

Ballast tracks, which are fitted with the standard superstructure also frequently, exhibit rail compression values that are too low for use in high-speed transport on new routes. The resilience of ballast permits track compression which results in a rail head depression of about 0.6 mm. This track compression is clearly below today's desired rail head depression of 1.5 mm.

This invention envisages the use of at least one resilient layer between the sleeper and the ballast track in order that the track system is self stabilizing.

The use of the resilient intermediate layer, typically in the form of a rubber pad, preferably reinforced can achieve a static spring rates of at least c=50–70 kN/mm, which will improve track compression to a rail head depression of above 1.0 mm (in conjunction with the ballast track).

To achieve good track compression and stabilization, a resilient intermediate pad is disposed between the rail sleeper and the ballast bed; this pad ensures sufficient compression.

In accordance with a preferred embodiment of the invention the resilient intermediate pad is reinforced therewithin or on the outside.

Thus the present invention is based on the object of using standard elements and standard sleepers to design a rail attachment, by means of which high rail compression values and proper self stabilization can be achieved.

The device for securing railway rails on a ballast track or a solid track includes a standard sleeper used on the ballast track; consisting of a plurality of gabions holding ballast and a resilient pad placed below the sleeper typically below the rail seat between the sleeper and the gabions.

In accordance with one embodiment of the invention the resilient intermediate pad and/or the gabions may have a larger extension in the sleeper's longitudinal direction than the rail flange and therefore protrude across the width of the rail flange on both sides. As a result, the pressure is distributed over a larger surface area of the ballast bed via the resilient intermediate pad.

In accordance with another embodiment the resilient pad may be secure with the gabion elements such that the upper wall surface may be flexible/resilient. Alternatively, the rubber resilient pad may be independent of the gabions. The gabions being typically of elements made of wire net or fabric. The resistance of the ballast bed to dynamic load and deformation will be favourably influenced if according to the invention the gabions filled with ballast material are under tension. This tension ensures that the ballast material in the gabion will hold together. The ballast material may be made up of various grades of pebble, crushed stone, pebble-sand mixtures or some other material of sufficient strength. To stabilize elasticity elastic components may be added to the ballast material.

Optionally, the resilient pad may be a bladder of a synthetic polymeric material, which may be placed in the gabion near the closure and inflated with compressed air after tying up the gabion. To this end also use may be made of waste products that are sufficiently elastic.

A simple embodiment of the railway track structure according to the invention is characterized in that beneath each sleeper there are positioned at least two gabions filled with ballast material. The gabions are advantageously so positioned beneath the sleepers that halfway between the two rails the two facing ends of the gabions are spaced at some distance apart. Said space is filled with ballast material or the like.

A particularly effective embodiment according to the invention is characterized in that the sleepers are each positioned within the upper part of a gabion. This provision has the advantage that the gabions need not be fastened to the sleepers.

Also instead of employing a solid wooden sleeper use may with advantage be made of a steel tube having a rectangular cross-section.

Favourable results may in principle also be obtained with the gabions extending beneath the sleepers in longitudinal direction of the rails.

According to the invention the gabions may be filled with some hard ballast material such as pebbles, broken stone, sand and/or slag. Favourable results are also expected if according to the invention the gabions are filled with a mixture of hard ballast material, such as pebbles, broken stone and/or sand, and elastic material, such as pieces of elastomeric material typically waste tyre crumb.

A favourable embodiment of the railway track structure according to the invention is characterized in that measured over their side resting on the subsoil, the filled gabions extending in longitudinal direction of the sleepers have varying lengths and varying transverse dimensions in longitudinal direction of the rails.

It is expected that a railway track structure comprising ballast gabions according to the invention will not require any maintenance for many years as far as the ballast bed is concerned. The gabions are porous and air and water will have access to the contents of the gabions. The filled gabions have a greater width than the sleepers, as a result of which the ballast bed will have a high load bearing capacity and the load is uniformly distributed. The ballast bed according to the invention is also expected to be of satisfactory use in desert-like regions with blowing sand. As a matter of fact, a conventional ballast bed is made impermeable to water by all the sand and loses its elasticity in that fine sand particles will deposit in the ballast bed.

The invention also comprises a method of building a railway track structure by which a bed of ballast material with sleepers and rails is provided, which is characterized according to the invention in that beneath the sleepers there are placed one or more gabions or like containers filled with ballast material. The gabions may with advantage be fastened to the sleepers. A favourable embodiment of the method according to the invention is characterized in that in the gabion filled with ballast material this material is set into vibration in order that it may be compacted before the gabion is closed. It is preferred that the ballast material is set into vibration at a frequency and at an amplitude such that the ballast material behaves practically like a liquid, and the gabion is closed while the ballast material in it is in vibratory motion or afterwards. In that way the filling of the gabions with ballast material will be optimal, with the wire net or fabric material of the filled gabions being tensioned.

When the gabions thus filled are fastened beneath the sleepers, the gabions are somewhat pre-tensioned. Because of this pre-tension the gabions will be more capable of taking up the high dynamic loads applied to the track due to the traffic thereover of trains. A favourable embodiment of the method according to the invention is characterized in that the gabion, after it has successively been filled with ballast material and closed, is so compressed by pre-tension transverse to its longitudinal direction that two opposed flattened faces are formed. For protection, the gabions placed on their supports may be covered with ballast material. In accordance with another embodiment of the invention to achieve a self stabilizing rail track system, at least one compressible resilient pad is positioned between the sleeper and the ballast gabions.

Laying a railway track according to the invention may be simplified by prefabricating a group of sleepers, say 4–6, with gabions filled with ballast material fastened to them and collectively fastening the whole construction to a carrier, such as a mounting rail, after which the carrier with sleepers and gabions is transported to the site for laying the railway track.

The invention also comprises a gabion-shaped body formed by a flexible container filled with ballast material, which body is formed in the manner described hereinbefore for use in the railway track according to the invention.

The invention also comprises a foundation for a railway, a building structure, a machine, a road or some other construction, which is characterized in that said foundation contains a plurality of the afore-described gabion-shaped bodies according to the invention.

BRIEF DESCRIPTION OF THE DRAWINGS

The invention will be further described with reference to the accompanying schematic drawings.

DETAILED DESCRIPTION OF THE DRAWINGS

Figure 1:
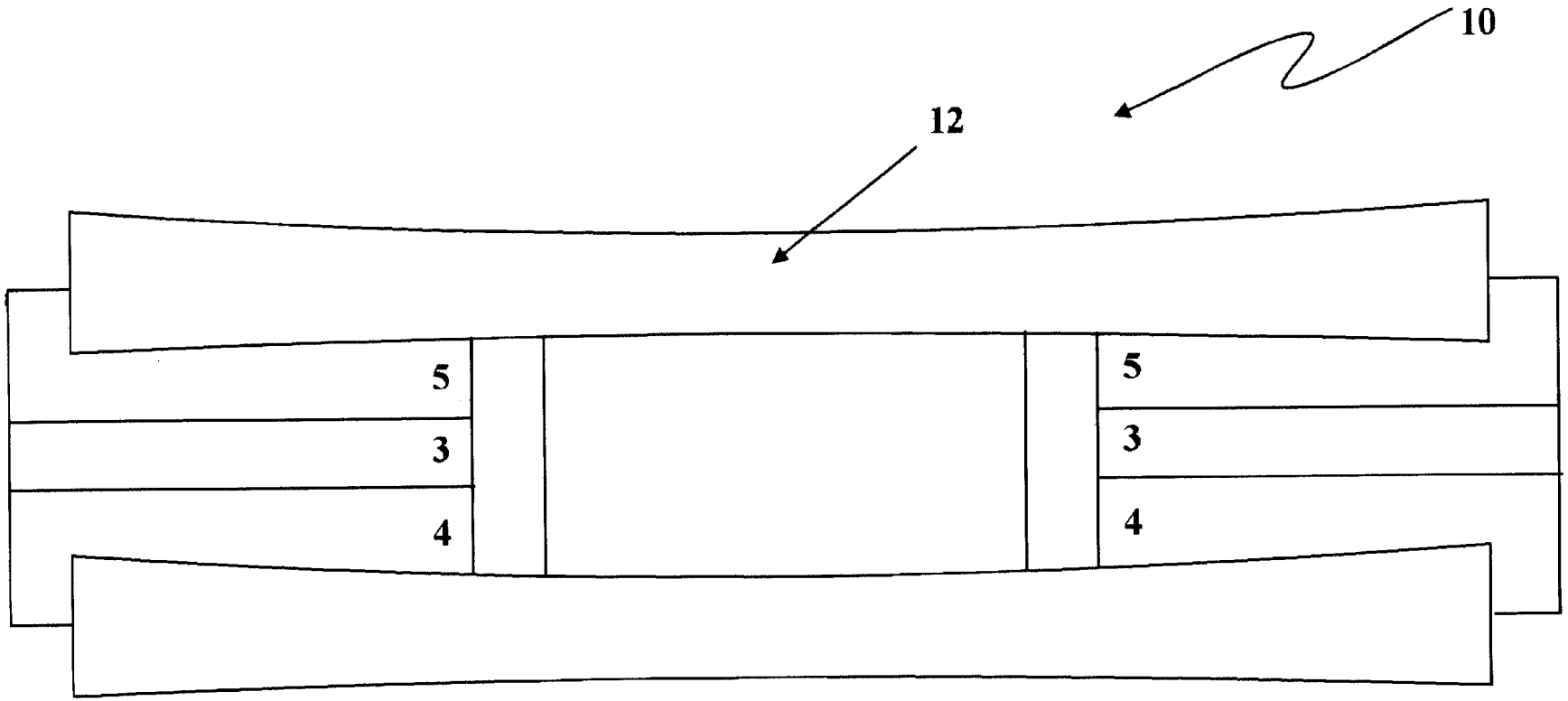
FIG. 1 is a plan view of a railway track structure according to the invention.

Referring to the drawings, a self-stabilizing railway track system in accordance with this invention is generally indicated by the reference numeral 10.

Figure 2:
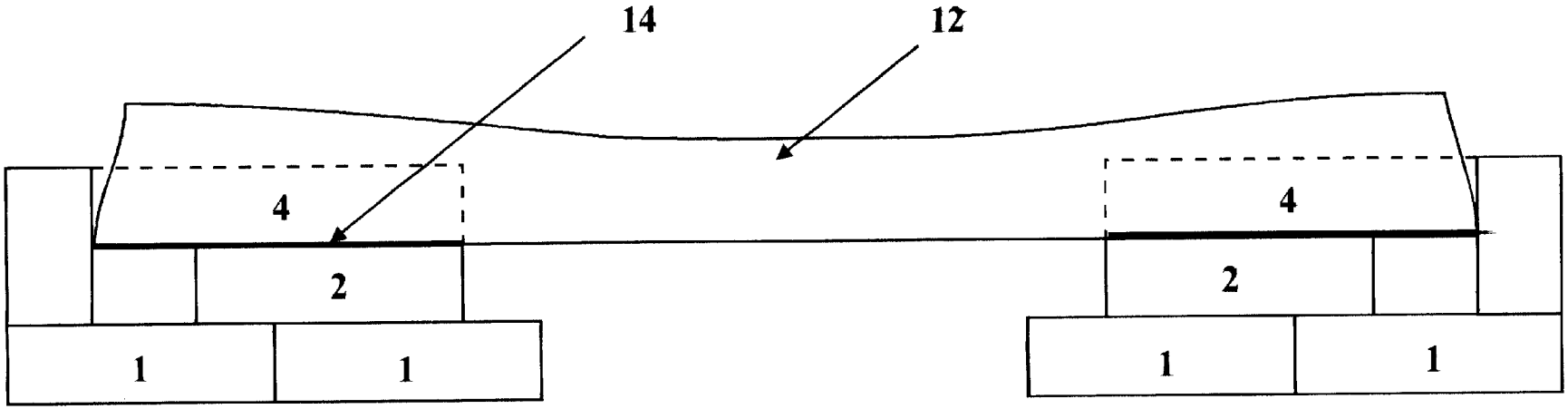
FIG. 2 shows a railway track structure of FIG. 1 in an elevation side view.
Figure 3:
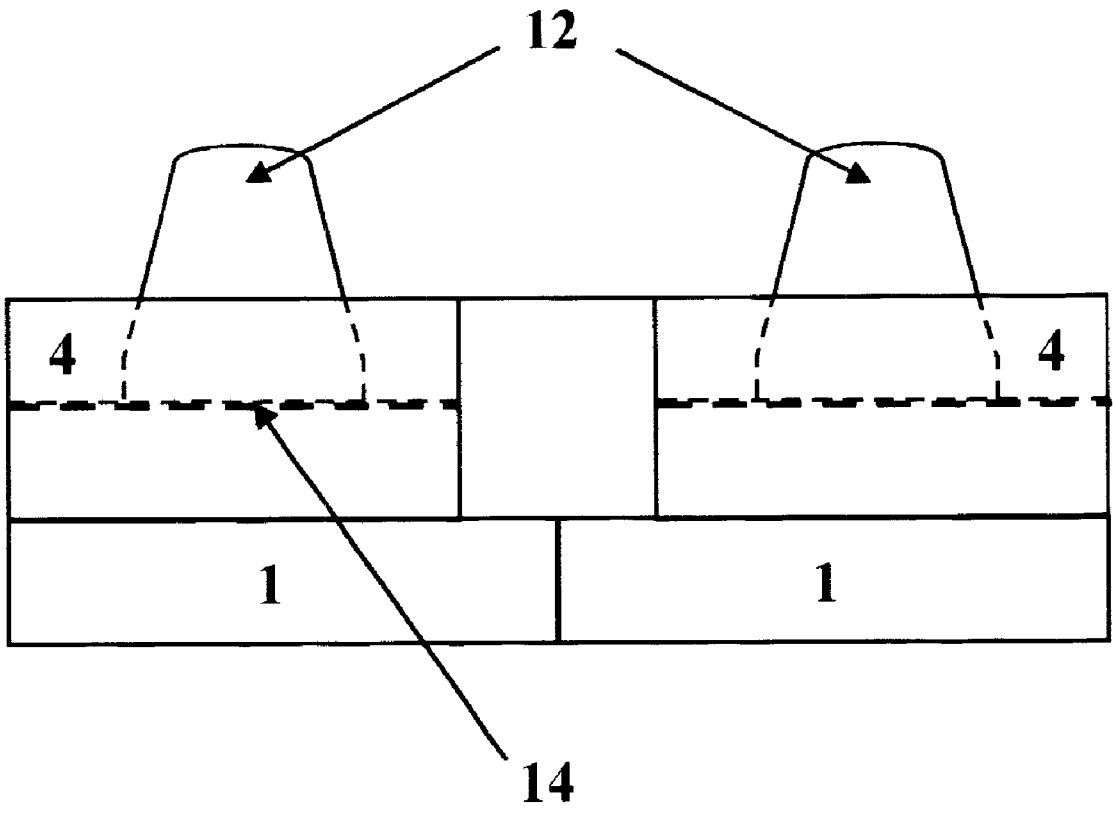
FIG. 3 is an end elevation view of the railway track structure of FIG. 1.
Figure 4:
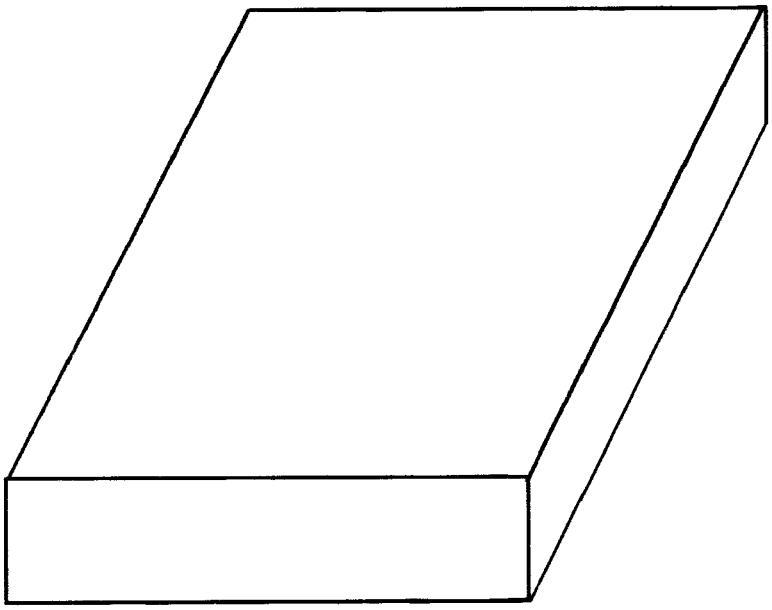
FIG. 4 is an isometric view of one of the gabions shown in FIG. 1.
Figure 5:
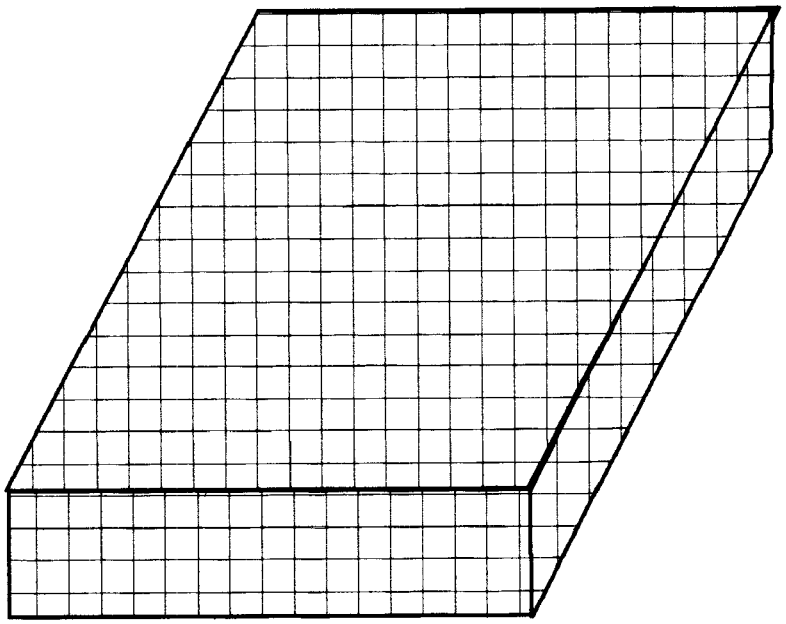
FIGS. 5 and 6 show other gabion embodiments.
Figure 6:
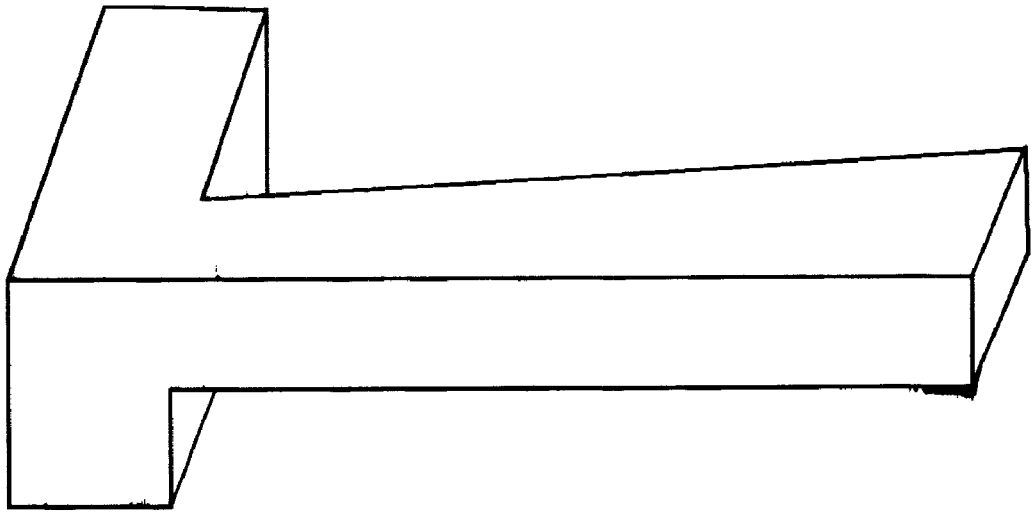

FIGS. 1–3 illustrate the track of which the sleepers are referred to by reference numeral 12 having rail seats at either end. The gabions are referred to by the numerals 1, 2, 4 and 5. The sleepers are spaced at about 65 cm centres apart. Beneath each sleeper 12 are the gabions 1, 2, 4 and 5 filled with ballast material such as coarse gravel or rubble. Each sleeper 12 may be fastened to the gabions 4 and 5. Fastening to the gabions 4 and 5 may be effected with the aid of optionally re-adjustable clamp couplings [not shown]. The rails are fastened to the sleepers 12 in a conventional manner, which is not shown. The gabions, which succeed each other in longitudinal direction of the rails, touch on their sides at the points. Alternatively, however, some small space may be left between the sides of the gabions. As the two facing ends of the gabions 4, 5 beneath each sleeper do not touch, some free space 3 is left in the centre of the track, halfway between the two rails. The subsoil supporting the gabions may be of the same kind as that of the ballast bed of a conventional railway track. A resilient layer 14 is provided between the sleeper 12 and the gabion arrangement.

In view of the magnitude of the loads applied to the track structure by the trains moving thereover the gabions are typically of a wire netting having a high tenacity.

FIGS. 4 5 6 and 7 are schematic illustrations of embodiments of gabions 1 and 2 and 4 and 5 respectively according to the invention in which the sleepers 12 are each positioned on gabions filled with ballast material. Typical shape and relative dimensions of the gabions are provided in the drawings, which are merely illustrative of the sizes of the gabions and are in no way limiting or restrictive in nature.

Figure 7:
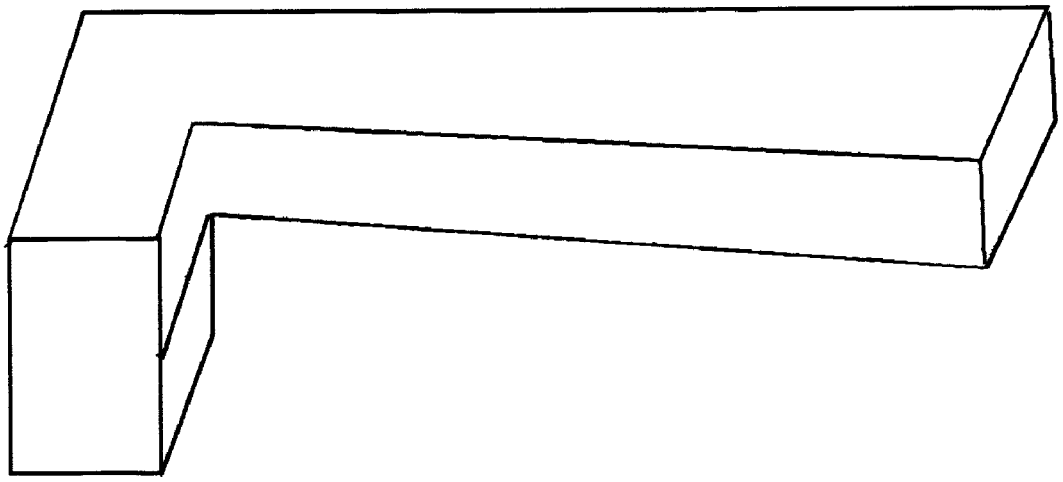
FIG. 7 shows a structure of a typical gabion in accordance with one embodiment of this invention.

A typical gabion construction is seen in FIG. 7 in which a support wall 16 of the gabion is seen in the form of a mesh and the gabion support element contains ballast material 18 in the form of pebbles or stones.

To prevent damage to the gabions protective material may be provided on the upperside of the sleepers both on the inside and the outside of the gabions.

The highly resilient intermediate pad 14 typically made of reinforced rubber allows the rail to exhibit the necessary vertical depression and can be selected such that the rail's desired compression is achieved. The pad evenly distributes over a large surface area those vertical forces, which act upon the rail. Since the resilient rubber pads 14 permits the required high rail compression in the form of a predetermined rail head depression of about 1.5 mm, the described rail attachment is also suitable for the use of high-speed trains on new routes. It is therefore possible to convert an existing ballast track to the securing system according to the invention by continuing to use standard sleepers, which also makes this system suitable for use in high speed transport because of their self stabilizing properties.

It is also possible to fill up the cavities of the ballast track with concrete, asphalt of the like and therefore to continue using this securing system on a solid track without changing the system because the manner of securing rails according to the invention achieves the desired high compression values as regards overall resilience even without the ballast foundation's contribution.

Although the invention has been described in terms of particular embodiments and applications, one of ordinary skill in the art, in light of this teaching, can generate additional embodiments and modifications without departing from the spirit of or exceeding the scope of the invention. Accordingly, it is to be understood that the drawings and descriptions herein are proffered by way of example to facilitate comprehension of the invention and should not be construed to limit the scope thereof.

I claim:

1. A track structure for fastening rails comprising

[i] a ballast bed consisting of a plurality of discrete gabion type inter fitting elements;

[ii] sleepers for fixing rails thereto adapted to be laid and fitted on the said ballast bed;

[iii] a resiliently compressible pad adapted to be provided between the said sleepers and the ballast bed.

2. A track structure as claimed in claim 1, in which said elements of the ballast bed are defined by support box type elements in which ballast material such as pebbles and broken stones is filled.

3. A track structure as claimed in claim 2, in which the support elements are in the form of wire boxes.

4. A track structure as claimed in claim 2 in which the support element is in the form of a box having perforated walls.

5. A track structure as claimed in claim 2, in which the walls of the support element are tensioned.

6. A track structure as claimed in claim 2, in which the ballast material filled in the support elements include resiliently compressible elements.

7. A track structure as claimed in claim 2, in which the resiliently compressible elements used in the ballast material are used rubber tyre crumbs.

8. A track structure as claimed in claim 2, in which the resilient pad is provided within the gabions forming the ballast bed.

9. A track structure as claimed in claim 2, in which the support element for the gabions forming the ballast bed has a wall, which constitutes the resilient pad.

10. A track structure as claimed in claim 1 in which the resilient pad provided between the sleeper and the ballast bed is an elastomeric sheet element.

11. A track structure as claimed in claim 10, in which the resilient pad is reinforced from the inside or the outside.

12. A track structure as claimed in claim 10, in which the resilient pad is provided on the surface of the gabions forming the ballast bed.

13. A ballast bed comprising of discrete gabion type inter fitting elements formed by filling support elements with ballast material at least some of the gabions provided with resilient pads for mounting sleepers thereon.

14. A ballast bed as claimed in claim 13, in which the ballast material includes crumbs of resilient material.

15. A ballast bed as claimed in claim 13 in which the support elements are in the nature of a wire box.

16. A ballast bed as claimed in claim 13 in which the resilient pad is a wall of the support element.

17. A ballast bed as claimed in claim 13 in which the resilient pad is provided either outside or inside the gabion.

18. A method of making a track structure consisting comprising the steps of (i) preparing a sub soil bed for forming the track structure thereon;

(ii) filling ballast material in support elements to form ballast gabions;

(iii) interfitting the ballast gabions to form a ballast bed over the subsoil bed;

(iv) providing resilient elements over distinct sleeper mounting locations on the formed ballast bed; and (v) fitting sleepers over the resilient elements.

* * * * *